US006328338B1

(12) United States Patent
Sherman et al.

(10) Patent No.: US 6,328,338 B1
(45) Date of Patent: Dec. 11, 2001

(54) PAGE MARKING SYSTEM AND METHOD

(76) Inventors: Lawrence M. Sherman, Sherman's Way, Westport, CT (US) 06880-5063; Richard J. Birch, 6 Woodland Dr., New London, NH (US) 03257; Brian S. Rosenbloom, 2801 Quebec St., NW., Apt. 428, Washington, DC (US) 20008

( * ) Notice: Subject to any disclaimer, the term of this patent is extended or adjusted under 35 U.S.C. 154(b) by 0 days.

(21) Appl. No.: 09/438,896

(22) Filed: Nov. 12, 1999

(51) Int. Cl.[7] ..... B42D 9/00

(52) U.S. Cl. ..... 281/42; 283/38; 283/42; 283/36; 281/41

(58) Field of Search ..... 281/42, 38, 51, 281/28, 22, 41; 116/239; 24/563; 40/658, 642, 360; 283/36–42

(56) References Cited

U.S. PATENT DOCUMENTS

| | | | | |
|---|---|---|---|---|
| Re. 34,759 | | 10/1994 | Boyette . | |
| 732,527 | | 6/1903 | Devlin . | |
| 803,709 | * | 11/1905 | Perrine | 283/117 |
| 1,053,671 | | 2/1913 | Stillwell . | |
| 1,089,764 | | 3/1914 | High . | |
| 1,193,421 | * | 8/1916 | Prettyman | 116/239 |
| 1,241,049 | * | 9/1917 | Stevens | 283/36 |
| 1,449,145 | * | 3/1923 | Clarkson | 283/60.1 |
| 2,034,413 | * | 3/1936 | Ottinger | 281/42 |
| 2,300,623 | * | 11/1942 | Hornung | 283/38 |
| 2,941,819 | | 6/1960 | Groody . | |
| 3,143,998 | | 8/1964 | Madden . | |
| 3,324,823 | | 6/1967 | Peters . | |
| 3,409,312 | | 11/1968 | Wills . | |
| 3,561,147 | * | 2/1971 | Valencia | 40/360 |
| 4,184,699 | * | 1/1980 | Lowe, Jr. | 281/41 |
| 4,509,759 | | 4/1985 | Small . | |
| 4,569,538 | * | 2/1986 | Kurschner | 281/42 |
| 4,571,107 | | 2/1986 | Takada . | |
| 4,842,303 | * | 6/1989 | Molenda | 281/38 |
| 5,088,770 | | 2/1992 | McCrea . | |
| 5,249,546 | * | 10/1993 | Pennelle | 116/234 |
| 5,540,513 | | 7/1996 | Wyant . | |
| 5,639,124 | | 6/1997 | Jung . | |
| 5,713,606 | * | 2/1998 | Kleinberg et al. | 281/42 |
| 5,876,145 | * | 3/1999 | Datum | 402/4 |

FOREIGN PATENT DOCUMENTS

| | | |
|---|---|---|
| 853 899 | 7/1949 | (DE) . |

* cited by examiner

*Primary Examiner*—Willmon Fridie, Jr.
(74) *Attorney, Agent, or Firm*—Mintz Levin Cohn Ferris Glovsky and Popeo PC

(57) ABSTRACT

A publication having a separation line indicated on at least one of the pages of the publication. The separation line has a first endpoint and a second endpoint. The first endpoint is located on or adjacent to a first edge of the page and a distance away from a second edge of the page; the first edge forms an angle with the second edge. The second endpoint is located a distance away from the first edge and a distance away from the second edge. The distance from the first endpoint to the second edge is greater than the distance from the second endpoint to the second edge. A page marker integral with the page is formed when the page is separated along the separation line. When the page marker is folded towards the second edge of the page, a portion of the page marker extends beyond the second edge. The page marker thus functions as a bookmark.

6 Claims, 13 Drawing Sheets

111
120
130
192
202
102(2)
115
204
112

111
120
130
192
202
102(2)
115
204
112

111
130
192
202
102(2)
115
120
112

111
502
130
192
102(2)
115
120
112

PAGE MARKING SYSTEM AND METHOD

BACKGROUND OF THE INVENTION

1. Field of the Invention

The present invention is generally related to page markers, and more specifically, to a page marker formed from a page of a book, magazine, newspaper, trade journal, catalog, telephone book and other like publications.

2. Discussion of the Background

While reading a publication, it is not uncommon for the reader to desire to mark one or more of the pages for future reference. For example, a person reading a magazine generally desires to easily recall the page where he or she last stopped reading. Additionally, for a publication that has an index, table of contents, or other page that is frequently accessed, a reader generally desires to mark those pages for easy reference so that the reader need not spend time flipping through the publication to find those pages.

A common practice for marking a page of interest for future reference is to place a small piece of paper on top of the page in such a way that when the publication is closed a portion of the small piece of paper projects beyond an edge of the page. Another commonly used technique for marking a page is to fold over a corner of the page. Both of these techniques have drawbacks. The small piece of paper may not be readily available at the particular time when it is needed, or it could easily fall out of the publication. Folded over corners suffer the disadvantage of being inconspicuous after the publication has been closed. Thus, they are often difficult to locate.

Solutions to overcome these problems have been attempted. For example, attempts have been made to provide page markers that could be formed from the page by the reader. U.S. Pat. No. 4,184,699 to Lowe, Jr. describes such a page marker. However, the drawbacks of these page markers is they are rather complicated and difficult to form.

What is, therefore, desired, is a page marking system and method that overcomes these and other disadvantages associated with conventional page marking devices.

SUMMARY OF THE INVENTION

Generally, the present invention provides a page marking system and method for marking pages of a publication. The present invention overcomes many of the drawbacks associated with conventional page markers, and further offers publishers of books, magazines, newspapers, trade journals, catalogs, telephone books and other like publications a new advertising opportunity.

In one aspect, the present invention provides a publication having a separation line indicated on at least one of the pages of the publication. The separation line has a first endpoint and a second endpoint. The first endpoint is located on or adjacent to a first edge of the page and a distance away from a second edge of the page; the first edge forms an angle with the second edge. The second endpoint is located a distance away from the first edge and a distance away from the second edge. The distance from the first endpoint to the second edge is greater than the distance from the second endpoint to the second edge. A page marker integral with the page is formed from the page when the page is separated along the separation line. When the page marker is folded towards the second edge of the page, a portion of the page marker extends beyond the second edge. The page marker thus functions as a bookmark.

Advantageously, the separation line is indicated on the page by perforating or weakening the page along at least a portion of the separation line. This feature facilitates the formation of the page marker. Also, an advertisement, uniform resource locator (URL), or other like item is printed on either side of the portion of the page from which the page marker is formed. This provides publishers new and unique advertising opportunities not heretofore contemplated. Additionally, a fold line can be indicated on the page to assist the reader in folding the page marker so that a portion of the page marker will extend beyond the second edge of the page.

The separation line can have various shapes. For example, the separation line can be a straight line or a curved line. The separation line can also have a first segment and a second segment. The segments can be straight or curved.

In another aspect, the present invention provides a method of marking a page of a publication. The method includes the step of separating the page along a separation line indicated thereon. The separation line has a first endpoint and a second endpoint. The first endpoint is located on or adjacent to a first edge of the page and is located a distance away from a second edge of the page; the first edge of the page forms an angle with the second edge of the page. The second endpoint is located a distance away from the first edge and a distance away from the second edge. A page marker integral with the page is formed as a result of the above step. The method also includes the step of folding the page marker along a fold line so that a portion of the page marker extends beyond the second edge of the page. In this manner, the page marker functions as a bookmark.

In one embodiment, the page is perforated along at least a portion of the separation line to facilitate the formation of the page marker. In another embodiment the page is weakened along at least a portion of the separation line for the same reason.

The method can further include the step of completely detaching the page marker from the page. The page marker may have a coupon printed thereon, and after being completely detached from the page, can be exchanged for a discount on merchandise. Advantageously, the page marker may have a URL printed thereon, and a reader of the publication can fully detach the page marker from the page, keep the page marker near his or her computer, and enter the URL into a web browser to retrieve the resource associated with the URL. In one embodiment, the page marker is a collectable item, such as a game piece.

In another aspect, the present invention provides a method of manufacturing a publication having a number of pages. The method includes the steps of indicating a separation line on at least one side of at least one of the pages and binding the pages together. The separation line has a first endpoint and a second endpoint. The first endpoint is located on or adjacent to a first edge of the page and a distance away from a second edge of the page; the first edge forms an angle with the second edge. The second endpoint is located a distance away from the first edge and a distance away from the second edge. The distance from the first endpoint to the second edge is greater than the distance from the second endpoint to the second edge. A page marker integral with the page is formed when the page is separated along the separation line. When the page marker is folded towards the second edge of the page, a portion of the page marker extends beyond the second edge. The page marker thus functions as a bookmark. Advantageously, the separation line is indicated by perforating the page or by weakening the page.

In another aspect, the present invention provides an advertising display space on which a plurality of symbols are printed. The display space is a portion of a page of a publication that lies between a first edge of the page and a separation line indicated on the page. The separation line has a first endpoint and a second endpoint. The first endpoint is located on or adjacent to the first edge of the page and a distance away from a second edge of the page; the second edge of the page forms an angle with the first edge. The second endpoint is located a distance away from the first edge and a distance away from the second edge. The distance from the first endpoint to the second edge is greater than the distance from the second endpoint to the second edge, and the distance from the second endpoint to the first edge is preferably less than about two inches. Advantageously, the display space becomes a page marker when the page is separated along the separation line.

In another aspect, the invention provides an advertising method. The advertising method comprises the steps of creating an advertisement, and printing the advertisement on a portion of a page of a publication. The portion is located between a first edge of the page and a separation line indicated on the page. The separation line has a first endpoint and a second endpoint. The first endpoint is located on or adjacent to the first edge of the page and a distance away from a second edge of the page; the second edge of the page forms an angle with the first edge. The second endpoint is located a distance away from the first edge and a distance away from the second edge. The distance from the first endpoint to the second edge is greater than the distance from the second endpoint to the second edge, and the distance from the second endpoint to the first edge is less than about two inches. Advantageously, the portion of the page of the publication becomes a page marker when the page is separated along the separation line.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1:
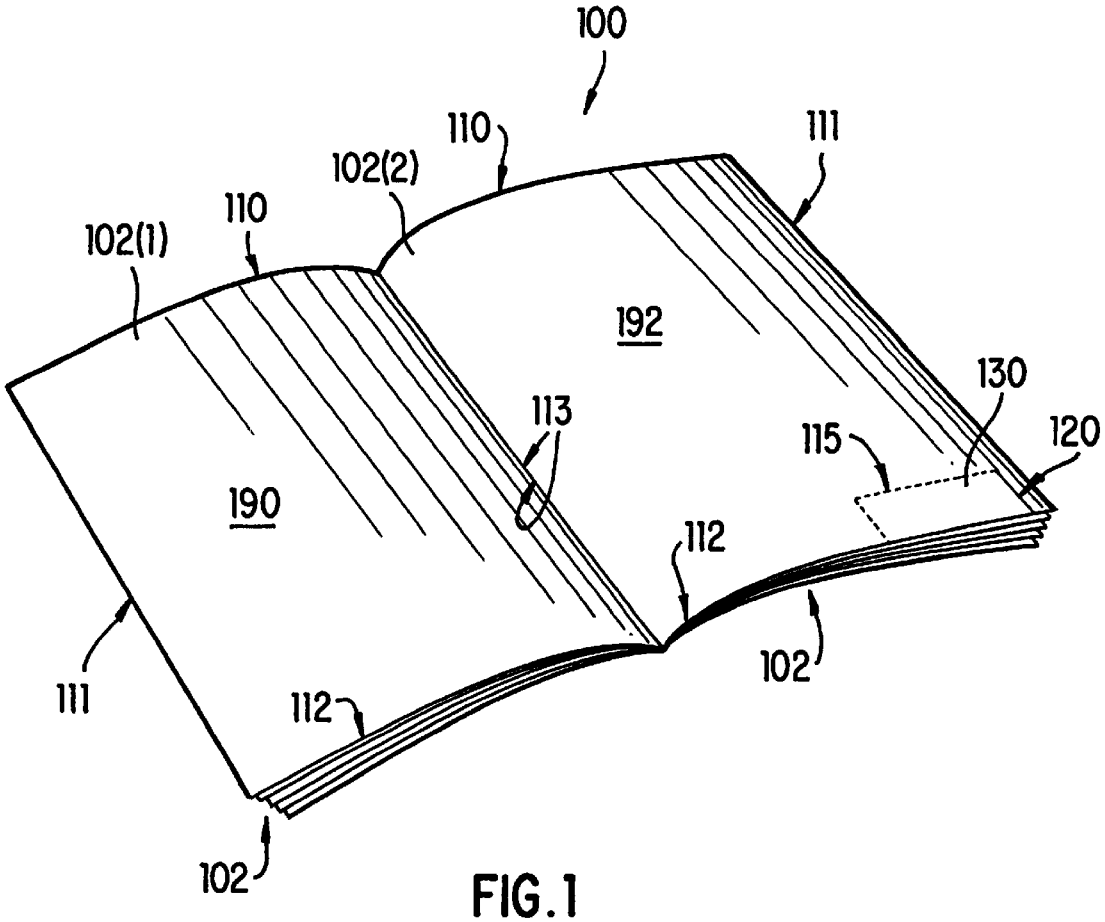
FIG. 1 is a perspective view of a publication according to one embodiment.

FIG. 1 is a perspective view of a publication 100 according to one embodiment. As used herein, the term publication is used broadly to refer to any of the following items, but is not intended to be limited to this list: books, magazines, newspapers, trade journals, catalogs, telephone books and other like publications.

Publication 100 includes a number of pages (also known as leaves) 102. Publication 100 is shown as being open to pages 102(1) and 102(2). Each page 102 has three edges: a top edge 110, a side edge 111, and a bottom edge 112. Conventionally, top edge 110 and bottom edge 112 are parallel and side edge 111 is perpendicular to both. Additionally, each page 102 has a front side and a back side. FIG. 1 shows the back side 190 of page 102(2) and the front side 192 of page 102(2). All of the pages 102 are bounded together at a spine 113. Publication 100 may also include one or more inserts (not shown) that are bound with pages 102. An insert is usually an advertisement or the like. Inserts (not shown) are distinguished from pages 102 in that inserts are cut from a different stock of paper than pages 102. Typically, inserts are made from a heavier stock of paper than pages 102. However, in some cases, inserts are made from a lighter stock of paper than pages 102. In a preferred embodiment, publication 100 is a magazine.

According to one embodiment, front side 192 of page 102(2) has a separation line 115 indicated thereon. When page 102(2) is separated along separation line 115, a portion 130 of page 102(2) becomes a page marker 130 that is integral with page 102(2). A separation line, like separation line 115, can be indicated on every page 102 of publication 100, every other page 102 of publication 100, or one or more selected pages of publication 100, such as a table of contents page, the first page of an index, or any other page that could require marking. Optionally, a fold line 120 is also indicated on front side 192 of page 102(2). Preferably, separation line 115 is indicated by perforating or weakening page 102(2) along separation line 115.

For a reader to mark page 102(2), the reader performs a two step process, which is illustrated in FIGS. 2–5. First, referring to FIGS. 2 and 3, the reader separates page 102(2) along separation line 115 so that portion 130 of page 102(2) becomes a page marker 130. This can be accomplished by, for example, cutting page 102(2) along separation line 115 or by pulling on portion 130 of page 102(2) with sufficient force to separate page 102(2) along separation line 115. In one embodiment, separation line 115 is perforated to facilitate the formation of page marker 130 from page 102(2). In another embodiment, page 102(2) is weakened along separation line 115 for the same reason.

Figures 2, 3, 4, 5:
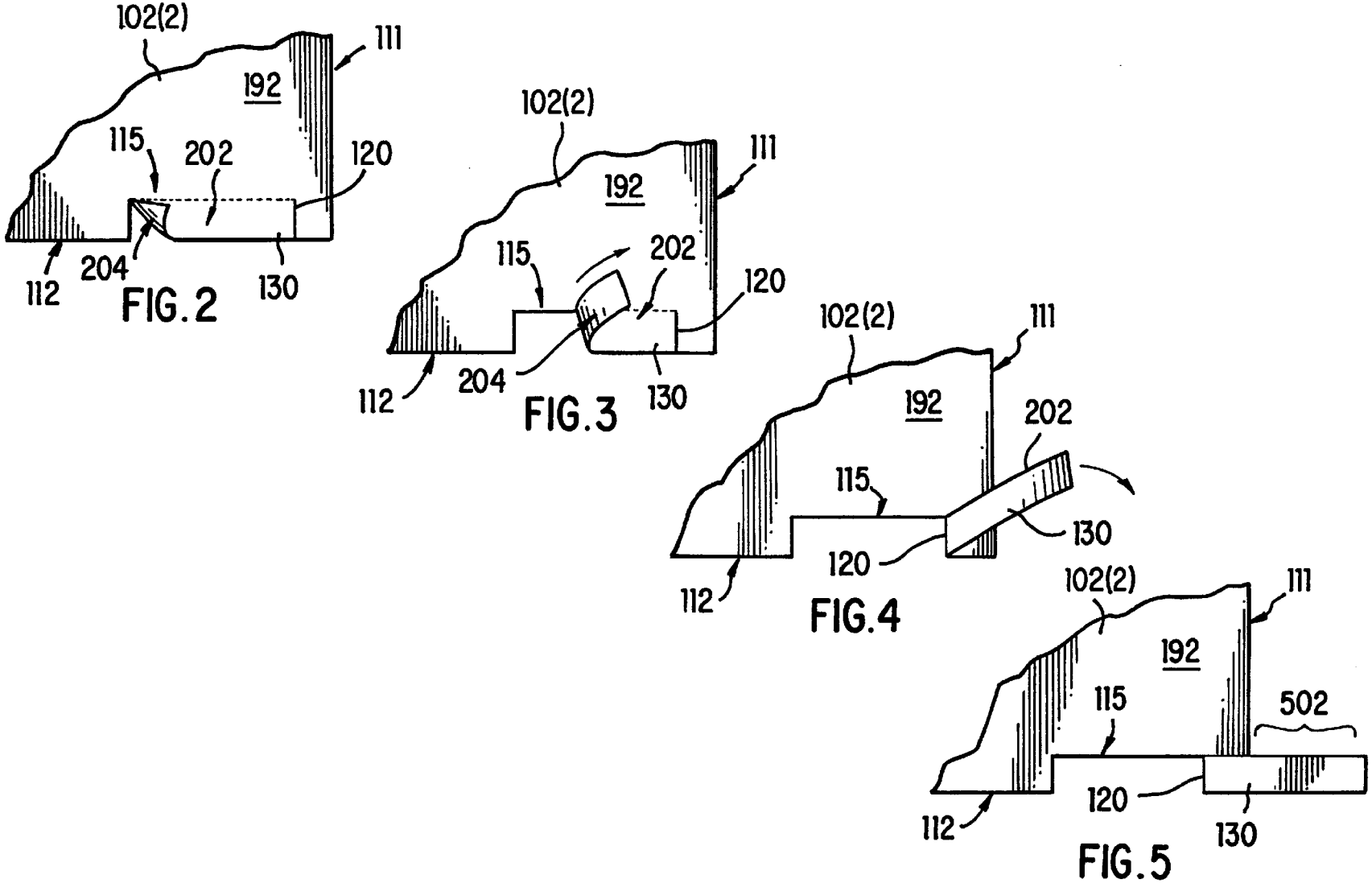
FIGS. 2 and 3 illustrate the step of separating a page along a separation line for the purpose of forming a page marker from the page.
FIG. 4 illustrates the step of folding a page marker along a fold line.
FIGS. 5 and 6 illustrate a portion of the page marker extending beyond an edge of the page after the page marker has been folded along a fold line.
Figure 6:
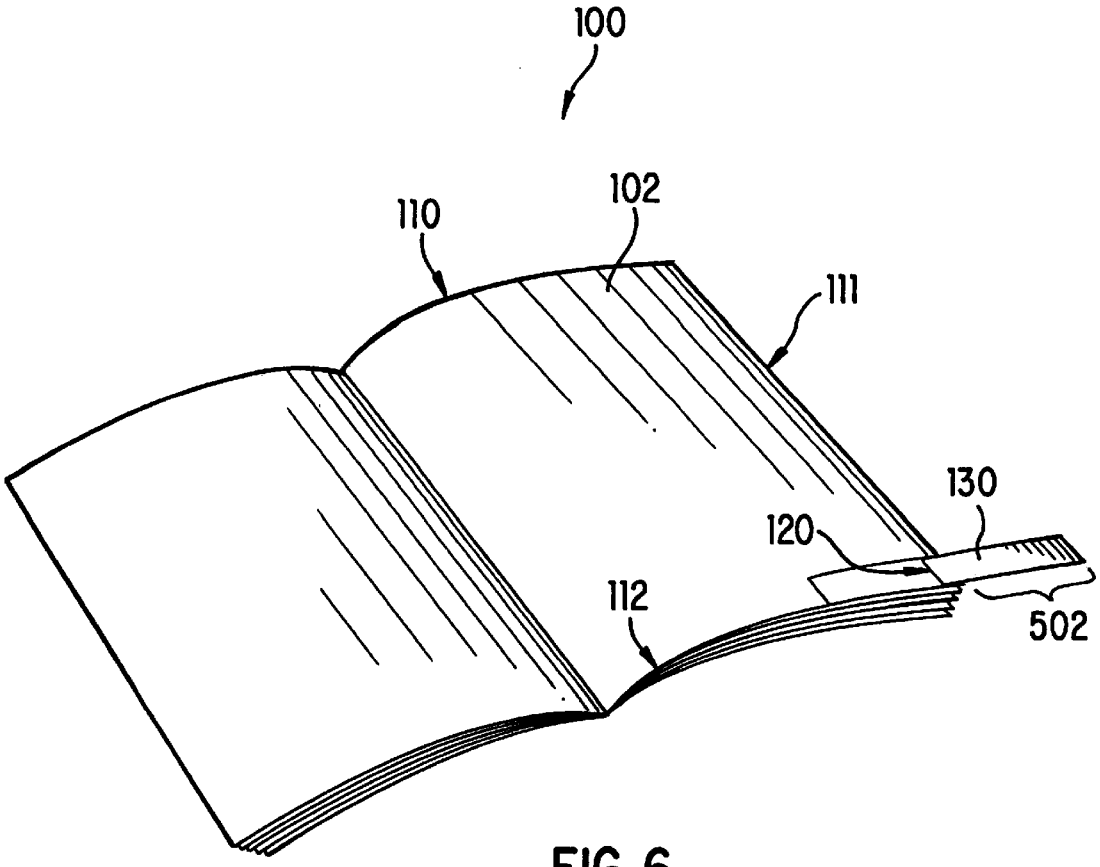

Second, referring to FIGS. 4 and 5, after forming page marker 130 from page 102(2), the reader next folds page marker 130 along a fold line 120 and over page 102(2) so that a front side 202 of page marker 130 contacts the front side 192 of page 102(2). Alternatively, the reader could fold page marker 130 along fold line 120 and under page 102(2) so that a back side 204 of page marker 130 contacts the back side (not shown) of page 102(2). Regardless of whether page marker 130 is folded over or under page 102(2), fold line 120 is oriented such that when page marker 130 is folded along fold line 120, a portion 502 of page marker 130 extends beyond edge 111, as illustrated in FIGS. 5 and 6.

Preferably, the length (L) of portion 502 ranges between about 0.25 inches and 5 inches. More preferably, L ranges between 0.5 inches and 3 inches, and most preferably between 1 and 2 inches. The width (W) of portion 502 preferably ranges between about 0.25 inches and about 2 inches.

Preferably, fold line 120 is the line along which page marker 130 remains connected to page 102(2), but this is not a requirement. Fold line 120 can extend from any point along separation line 115 to edge 112, provided that the distance from the fold line to edge 111 is less than the distance from the fold line to the point on separation line 115 that is furthest from edge 111.

Figure 7:
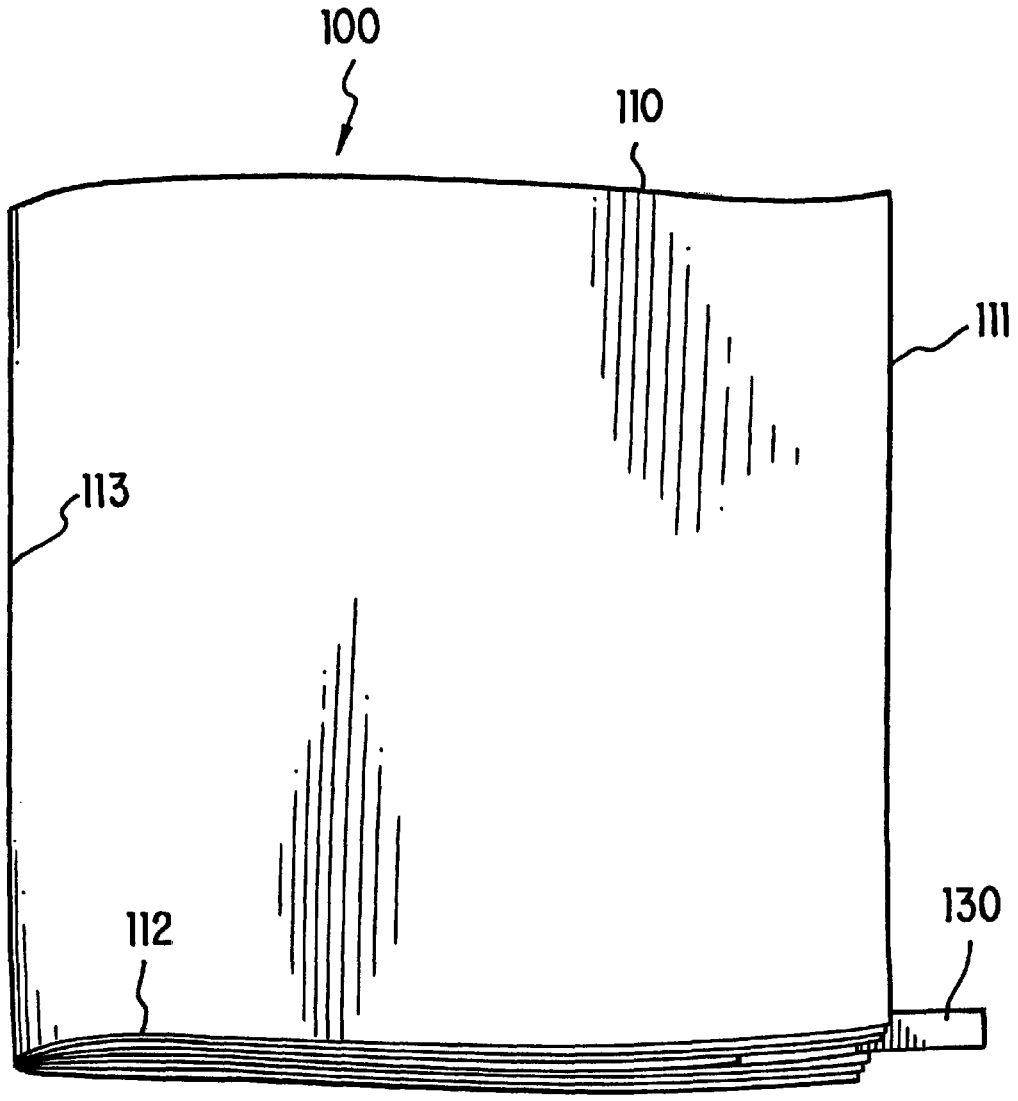
FIG. 7 illustrates that when the publication is closed a portion of the page marker is clearly visible when the page marker has been folded along a fold line.

Because top portion 502 of page marker 130 extends beyond an edge of page 102(2), top portion 502 of page marker 130 is clearly visible when publication 100 is closed, as illustrated in FIG. 7. Thus, page marker 130 functions as a bookmark and enables the reader to quickly and easily return to page 102(2) without having to spend time flipping through the publication 100.

Figure 8:
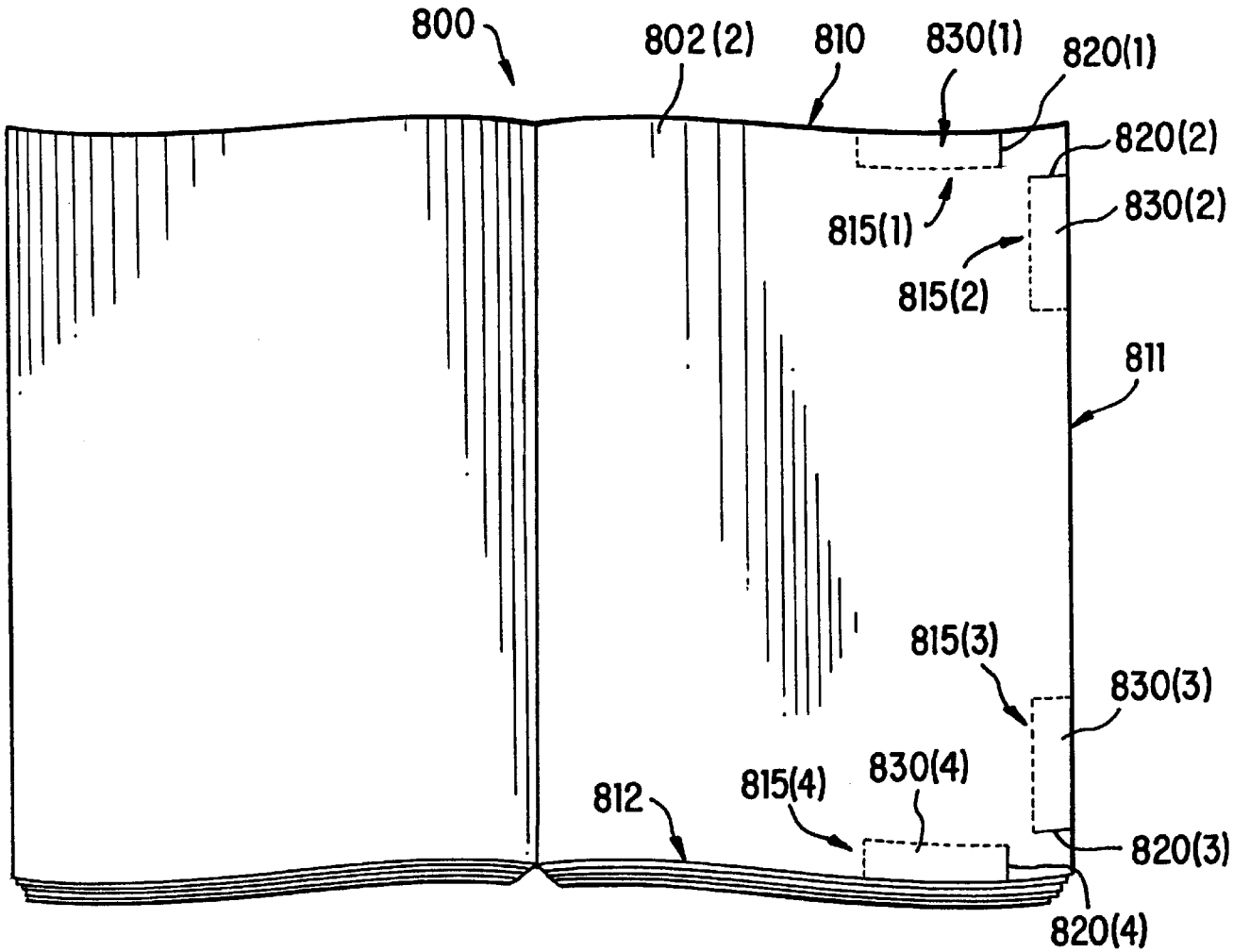
FIG. 8 illustrates the various possible placements of separation lines.

FIG. 8 is a diagram of a publication 800. The diagram illustrates four separation lines 815(1)–815(4) indicated on a page 802(2) of publication 800. FIG. 8 demonstrates that a page marker can be formed to extend not only beyond a side edge 811 of page 802(2), but also a top edge 810 and a bottom edge 812 of page 802(2).

As shown in FIG. 8, separation lines 815(1)–(4) are indicated on page 802(2). When page 802(2) is separated along separation line 815(1), a portion 830(1) of page 802(2) becomes a page marker 830(1) integral with page 802(2). After separating page 802(2) along separation line 815(1), page marker 830(1) can be folded along fold line 820(1), which causes a portion of page marker 830(1) to extend beyond side edge 811. Likewise, when page 802(2) is separated along separation line 815(2) a page marker 830(2) integral with page 802(2) is formed. When page marker 830(2) is folded along fold line 820(2), a portion of page marker 830(2) extends beyond top edge 810. Similarly, when page 802(2) is separated along separation line 815(3) a page marker 830(3) integral with page 802(2) is formed. When page marker 830(3) is folded along fold line 820(3), a portion of page marker 830(3) extends beyond bottom edge 812. Lastly, when page 802(2) is separated along separation line 815(4) a page marker 830(4) integral with page 802(2) is formed. When page marker 830(4) is folded along fold line 820(4), a portion of page marker 830(4) extends beyond side edge 811.

The advantages of the page marking system just described are clear. First, unlike a slip of paper that functions as a bookmark, the page markers of the present invention will not inadvertently fall out of the publication because they are formed integral with the page that they are intended to mark. Also, unlike a folded over corner of a page, which is inconspicuous when the publication is closed, top portion 502 of a page marker 130 is easily spotted when the publication 100 is closed, as shown by FIG. 7.

Figure 9A:
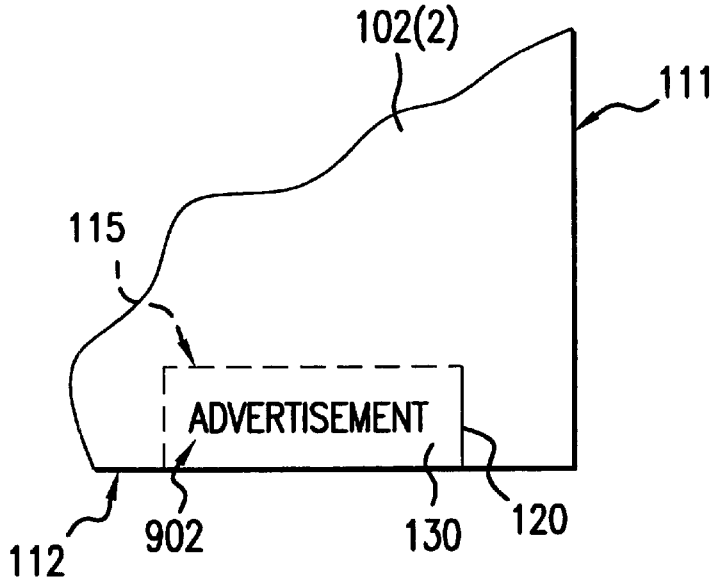
FIG. 9A is a diagram of a page marker with advertising printed thereon.
Figure 9B:
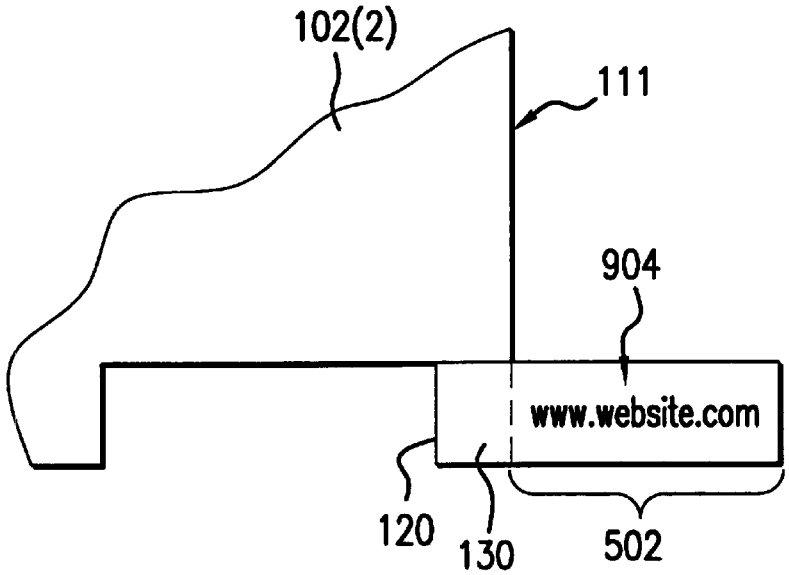
FIG. 9B is a diagram of the page marker with a uniform resource locator (URL) printed thereon.

The page marking system of the present invention provides other advantages as well. For example, referring to FIG. 9A, an advertisement 902 can be printed on the front side 202 and/or the back side 204 of the portion 130 of page 102(2) that becomes page marker 130 when page 102(2) is separated along separation line 115. Additionally, FIG. 9B shows a uniform resource locator (URL) 904 printed on the front side 202 and/or back side 204 of the portion 130 of page 102(2). Preferably, URL 904 is printed on the portion 502 of page marker 130 so that when the publication 100 is closed, the URL 904 is visible.

Figure 9C:
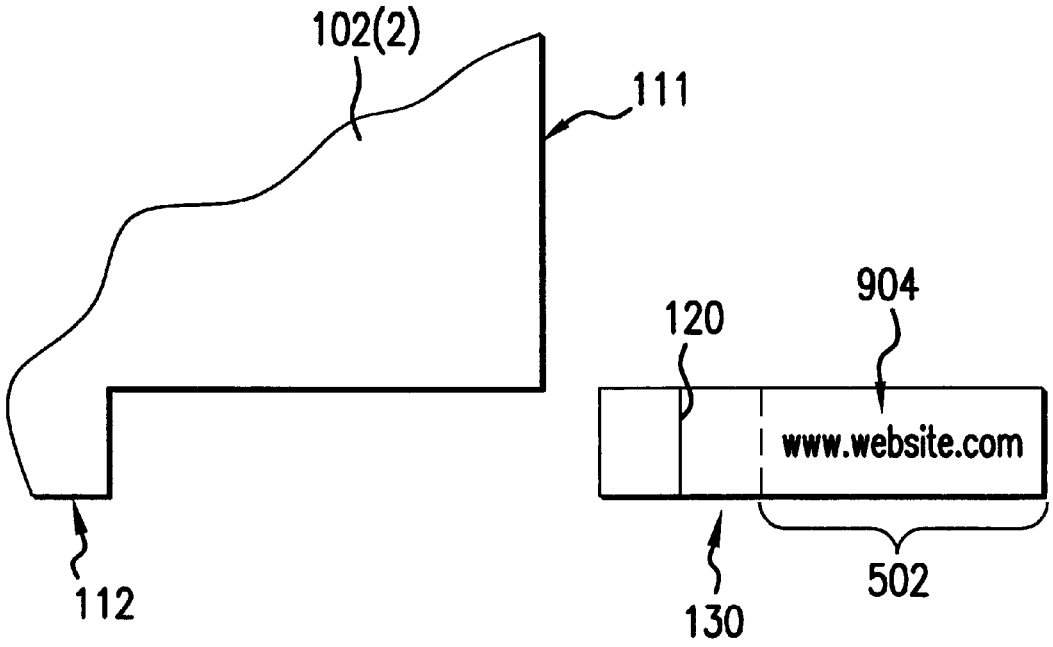
FIG. 9C illustrates the pager marker after it has been fully detached from the page.

When the user does not require page marker 130 to mark page 102(2), the user can fully detach page marker 130 from page 102(2). The reader can accomplish this by separating the paper along separation line 115, if the reader has not already done so. Next, the reader pulls on, for example, portion 502 of page marker 130 with sufficient force to fully detach page marker 130 from page 102(2), as shown in FIG. 9C.

After page marker 130 has been fully detached from page 102(2), the reader can carry the page marker 130 to his or her computer and enter the URL printed thereon into a web browser or other like software application. In this manner, the reader locates the resource addressed by the URL 904. In another embodiment, the detached page marker functions as a collectable game piece. For example, one number from 1 to 10 could be printed on each page marker, and an object of the game would be for the reader to collect page markers until all of the numbers 1 to 10 have been collected. The reader would then exchange the collection of page markers for a prize.

FIGS. 10A–D demonstrate that page marker 130 can function not only as a bookmark, but also as a coupon or other like item of commerce. That is, a discount amount or value 1002 can be printed on page marker 103. When the reader no longer requires page marker 130 to mark page 102(2), the reader can fully detach page marker 130 from page 102(2) and exchange page marker 130 for a discount on merchandise or use page marker 130 to obtain merchandise.

Figure 10A:
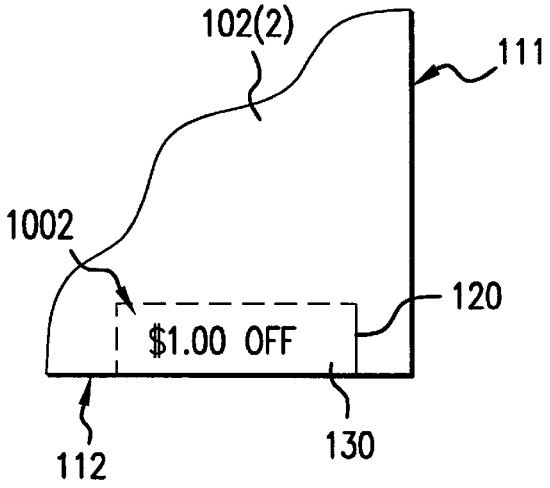
FIGS. 10A–C are diagrams illustrating that the page marker can function not only as a bookmark, but also as a coupon or other like item of commerce.
Figure 10B:
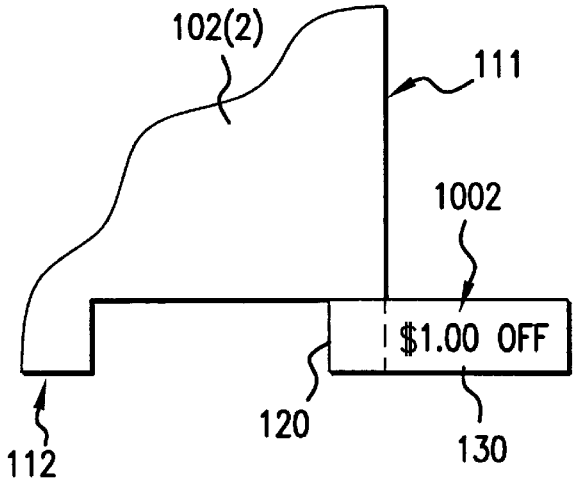
Figure 10C:
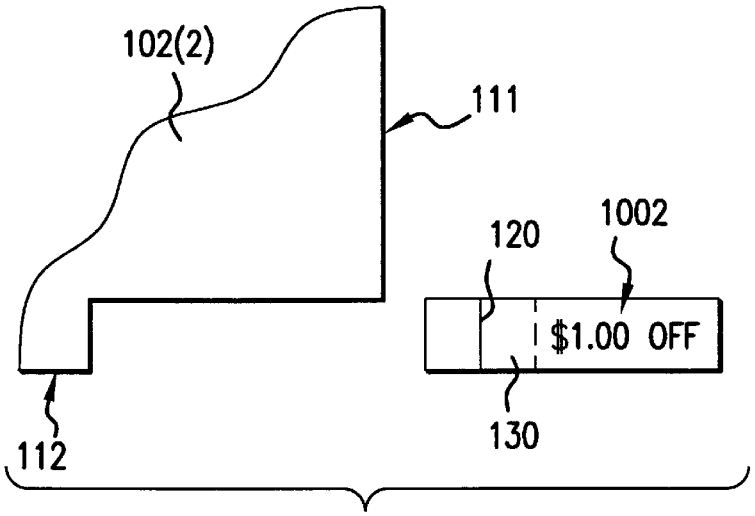
Figure 10D:
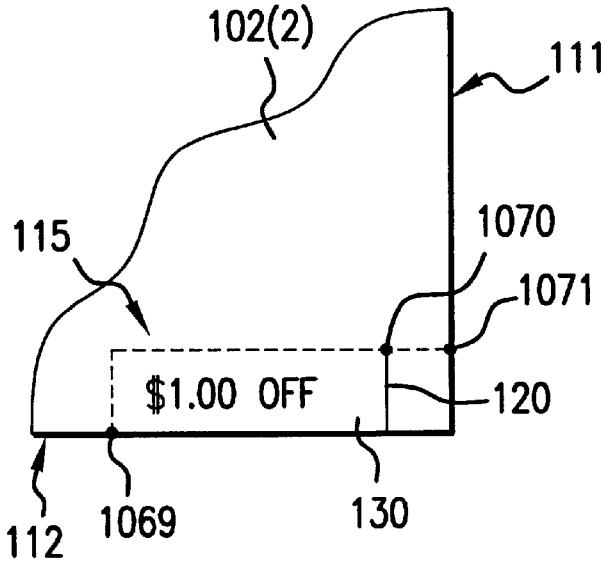
FIGS. 10D and 10E illustrate exemplary configurations that facilitate the complete detachment of a page marker from the page.

In one embodiment, which is shown in FIG. 10D, separation line 115 extends from a point 1069 on edge 112 to a point 1071 on edge 111 to facilitate the full detachment of page marker 130 from page 102(2). Fold line 120, however, remains in the same location as before. That is, fold line 120 extends from a point 1070 on separation line 115 to edge 112. In this embodiment, the reader can bookmark page 102(2) by first separating page 102(2) from point 1069 on edge 112 to point 1070 along separation line 115, thereby forming page marker 130 from page 102(2), and then by folding page marker 130 along fold line 120. To use page marker 130 as a coupon, the reader would simply fully detach page marker 130 from page 102(2) by further separating page 102(2) along the separation line from point 1070 to point 1071. To facilitate the detachment of page marker 130, separation line 115 can be perforated or page 102(2) can be weakened along separation line 115.

Figure 10E:
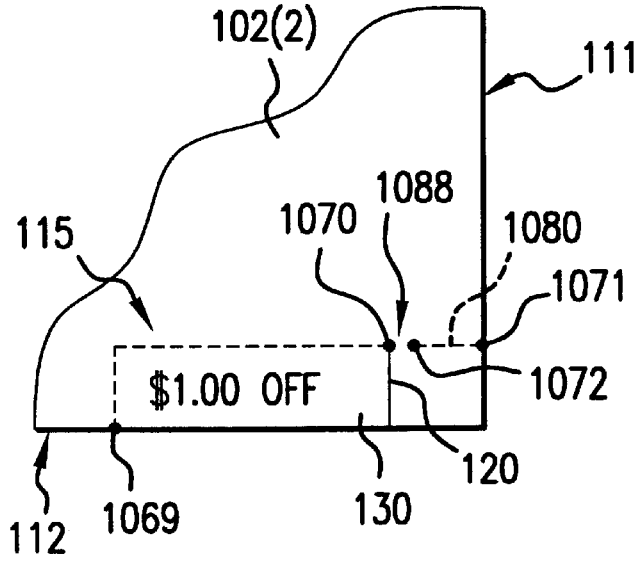

In another embodiment, which is shown in FIG. 10E, there is provided a second separation line 1080. Separation line 1080 extends from a point 1072 within page 102(2) to point 1071 on edge 111. A gap 1088 is provided between point 1070 and point 1072. Gap 1088 functions to prevent the reader who wants to use page marker 130 as a bookmark from inadvertently completely detaching page marker 130 from page 102(2). Separation line 1080 functions to facilitate the complete detachment of page marker 130 from page 102(2) in those situations where the reader desires to fully detach page marker 130. Gap 1088 shouldn't be so large that separation line 1080 is not able to perform its function.

Referring now to FIGS. 11–18, various embodiments of a page marking system according to the present invention will be described in further detail, however, the invention is not intended to be limited to these or any other particular embodiments. It should be understood that these embodiments are being presented by way of example only, and not limitation.

Figure 11:
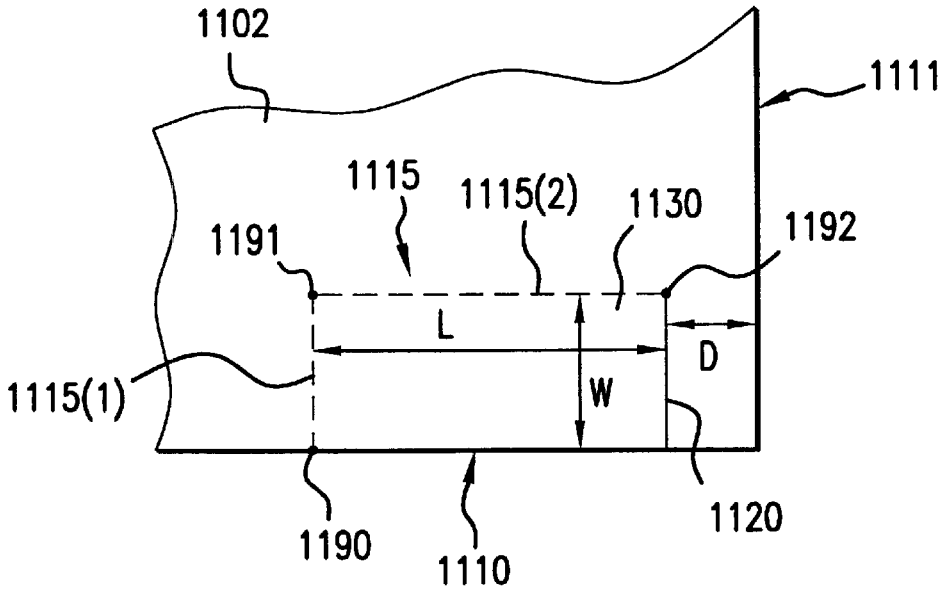
FIGS. 11–18 illustrate various embodiments of a page marking system according to the present invention.

Referring to FIG. 11, there is shown a separation line 1115 indicated on page 1102. Separation line 1115 has a first endpoint 1190, which is located on or adjacent to a first edge 1110 of page 1102, and a second endpoint 1192, which is within (or on) page 1102. Second endpoint 1192 is located a distance D away from a second edge 1111 of page 1102, and is located a distance W away from first edge 1110.

Separation line 1115 has two segments; a first segment 1115(1) and a second segment 1115(2). First segment 1115 (1) extends from endpoint 1190 to an intermediary point 1191. Second segment 1115(2) extends from intermediary point 1191 to endpoint 1192. In this embodiment, segment 1115(1) is substantially perpendicular to edge 1110 and segment 1115(2) is substantially parallel with edge 1110. A fold line 1120 is preferably indicated on page 1102, but this is not a requirement. In a preferred embodiment, fold line 1120 extends from endpoint 1192 to edge 1110 and is perpendicular with edge 1110. However, it is contemplated that the angle 1195 between fold line 1120 and edge 1110 is less than 90 degrees.

Preferably, the distance (D) from fold line 1120 to edge 1111 is at least about 0.07 inches. More preferably, D is between about 0.07 inches and 1 inch. Most preferably, D is about 0.25 inches. Preferably, the length (L) of the portion 1130 page 1102 that becomes a page marker when page 1102 is separated along separation line 1115 is at least about 0.5 inches. More preferably, L is between about 0.75 inches and 6 inches. Most preferably, L is about 2 inches. Preferably, the width (W) of portion 1130 is at least about 0.20 inches. More preferably, W is between about 0.25 inches and about 5 inches. Most preferably, W is about 0.5 to 1 inch.

As mentioned above, when page 1102 is separated along separation line 1115, a page marker integral with page 1102 is formed from page 1102. More specifically, portion 1130 of page 1102 becomes the page marker. The dimensions of the page marker (i.e., portion 1130) are such that when the page marker is folded towards edge 1111 (for example, folded along fold line 1120) a portion of the page marker extends beyond edge 1111, whereby the page marker functions as a bookmark.

Figure 12:
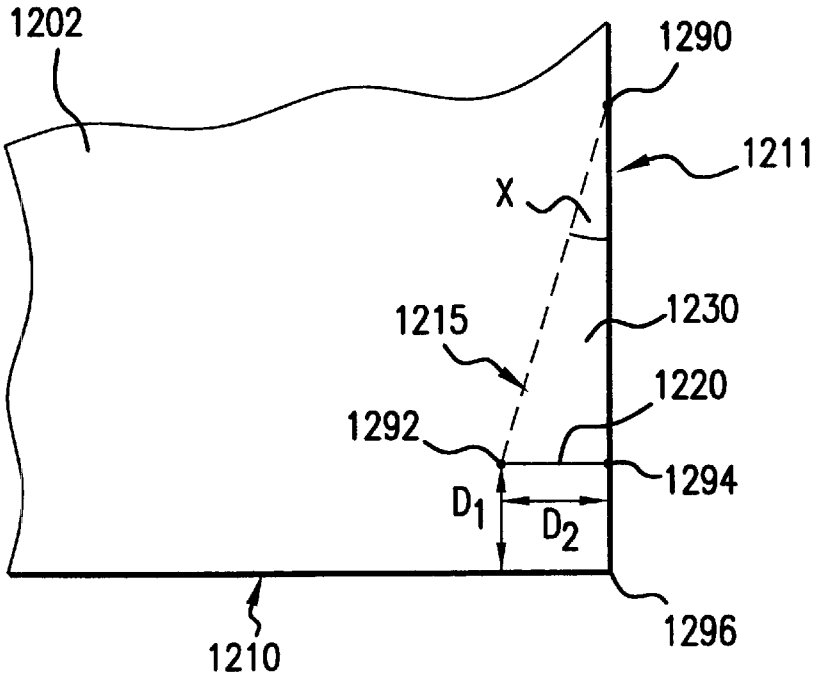

Referring to FIG. 12, there is shown a separation line 1215 indicated on page 1202. Separation line 1215 is substantially straight and extends from a point 1290 on or adjacent to edge 1211 to a point 1292 within page 1202. Point 1292 is a distance $D_1$ from edge 1210 and a distance $D_2$ from edge 1211. $D_1$ preferably ranges between 0.07 inches and 1 inch, and $D_2$ preferably ranges between 0.5 inches to 1 inch. However, other ranges are contemplated.

Optionally, a fold line 1220 is also indicated on page 1202. Preferably, fold line 1220 extends from point 1292 to edge 1211 and is parallel with edge 1210, but this is not a requirement. Edge 1211 is preferably the side edge of page 1202 and edge 1210 is either the top edge or the bottom edge of page 1202. Alternatively, edge 1211 could either be the top edge or the bottom edge of page 1202, in which case edge 1210 would be the side edge of the page. The distance between point 1290 and point 1294 is greater than the distance from point 1294 to the corner 1296 of page 1202.

As mentioned above, when page 1202 is separated along separation line 1215, a page marker integral with page 1202 is formed from page 1202. More specifically, portion 1230 of page 1202 becomes the page marker. The dimensions of the page marker (i.e., portion 1230) are such that when the page marker is folded towards edge 1210 (for example, folded along fold line 1220) a portion of the page marker extends beyond edge 1210, whereby the page marker functions as a bookmark.

Figure 13:
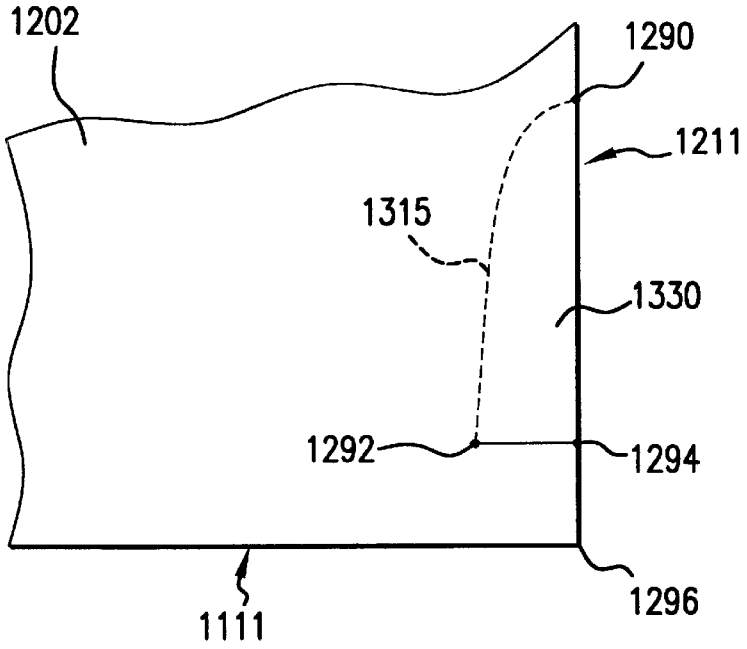

Referring to FIG. 13, there is shown a separation line 1315 indicated on page 1302. The page marking system shown in FIG. 13 is similar to the system shown in FIG. 12, with the exception that separation line 1315 is a curved line as opposed to a straight line.

Figure 14:
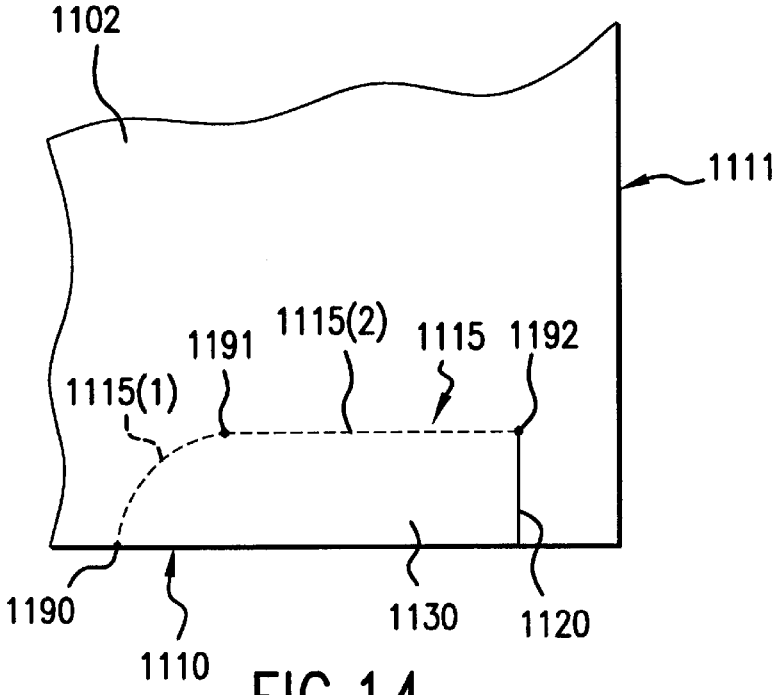
Figure 15:
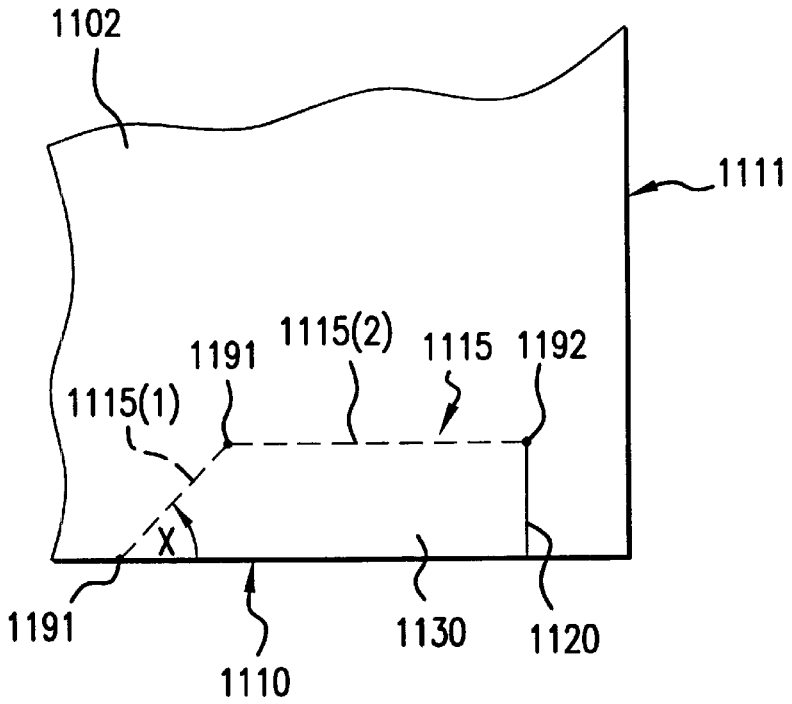
Figure 16:
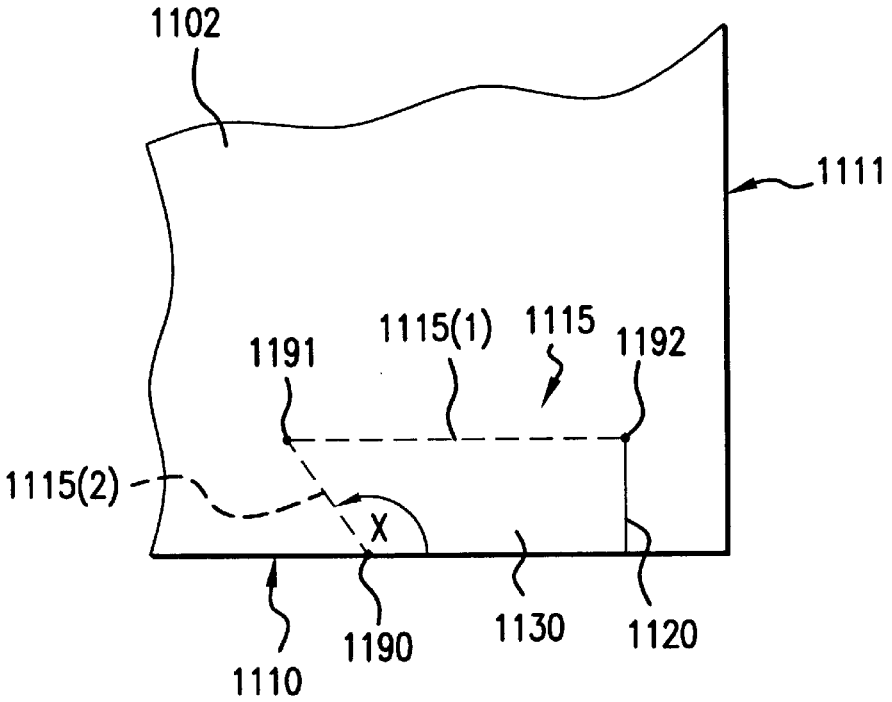
Figure 17:
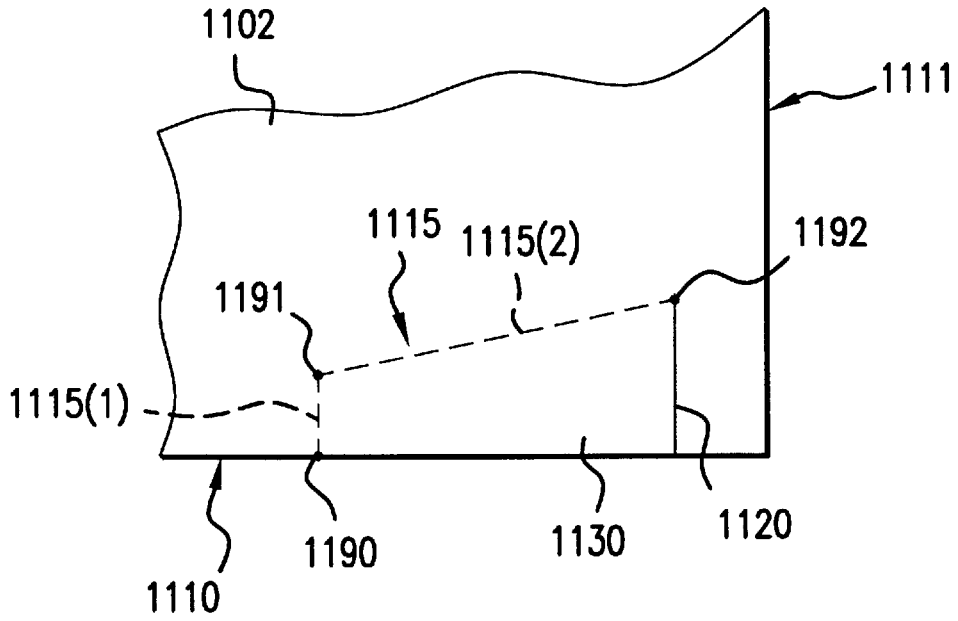
Figure 18:
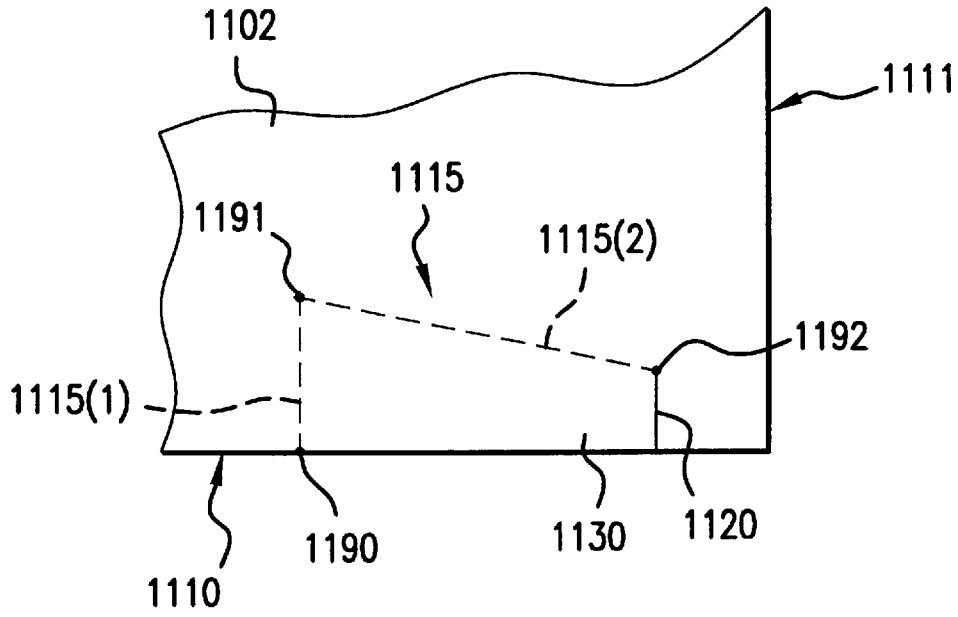

FIGS. 14–18 illustrate some of the possible variations of the page marking system shown in FIG. 11. Referring to FIG. 14, separation line segment 1115(1) is shown as being curved as opposed to being straight. Referring to FIGS. 15 and 16, separation line segment 1115(1) is shown as being a straight line, but not perpendicular to edge 1110. In FIG. 15, segment 1115(1) is shown forming an angle (X) with edge 1110, wherein X is less than ninety degrees. In FIG. 16, segment 1115(1) is shown forming an angle (X) with edge 1110, wherein X is greater than ninety degrees. Referring to FIGS. 17 and 18, separation line segment 1115(2) is shown as not being parallel with edge 1110.

While various embodiments/variations of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A publication, comprising:

a plurality of pages bound together, each of said plurality of pages having a first edge and a second edge forming an angle with said first edge, each of said plurality of pages also having a first side and a second side; and a separation line indicated on at least said first side of at least one of said plurality of pages, said separation line being a substantially straight line having a first endpoint and a second endpoint, said first endpoint being located on or at said first edge of said at least one of said plurality of pages and a distance away from said second edge of said page, said second endpoint being located a distance away from said first edge and a distance away from said second edge, said distance from said first endpoint to said second edge being greater than said distance from said second endpoint to said second edge, wherein a page marker integral with said page is formed from said page when said page is separated along said separation line.

2. A method of manufacturing a publication having a plurality of pages, comprising:

indicating a separation line on at least a first side of at least one of the plurality of pages, said separation line being a substantially straight line having a first endpoint and a second endpoint, said first endpoint being located on or at a first edge of said at least one of the plurality of pages and located a distance away from a second edge of said page, wherein said second edge forms an angle with said first edge, said second endpoint being located a distance away from said first edge and a distance away from said second edge, said distance from said first endpoint to said second edge being greater than said distance from said second endpoint to said second edge, wherein a page marker integral with said page is formed from said page when said page is separated along said separation line; and binding the plurality of pages together.

3. A publication, comprising:

a plurality of pages bound together, each of said plurality of pages having a first edge and a second edge forming an angle with said first edge, each of said plurality of pages also having a first side and a second side; and a separation line indicated on at least said first side of at least one of said plurality of pages, wherein said separation line has a first segment and a second segment, said first segment being a curved line and extending from a first point on or at said first edge of said at least one of said plurality of pages to a second point spaced inwardly from said first edge, said second point being closer to said second edge than said first point, said second segment being substantially parallel with said first edge and extending from said second point to a third point on said page, said third point being closer to said second edge than said second point, and when said page is separated along said separation line, a page marker integral with said page is formed from said page.

4. A publication, comprising:

a plurality of pages bound together, each of said plurality of pages having a first edge and a second edge forming an angle with said first edge, each of said plurality of pages also having a first side and a second side; and a separation line indicated on at least said first side of at least one of said plurality of pages, wherein said separation line has a first segment and a second segment, said first segment being a substantially straight line and extending from a first point on or at said first edge of said at least one of said plurality of pages to a second point spaced inwardly from said first edge, said second point being closer to said second edge than said first point, said second segment being substantially parallel with said first edge and extending from said second point to a third point on said page, said third point being closer to said second edge than said second point, and when said page is separated along said separation line, a page marker integral with said page is formed from said page.

5. A method of manufacturing a publication having a plurality of pages, comprising:

indicating a separation line on at least a first side of at least one of the plurality of pages; and binding the plurality of pages together, wherein said separation line has a first segment and a second segment, said first segment being a curved line and extending from a first point on or at said first edge of said at least one of said plurality of pages to a second point spaced inwardly from said first edge, said second point being closer to said second edge than said first point, said second segment being substantially parallel with said first edge and extending from said second point to a third point on said page, said third point being closer to said second edge than said second point, and when said page is separated along said separation line, a page marker integral with said page is formed from said page.

6. A method of manufacturing a publication having a plurality of pages, comprising:

indicating a separation line on at least a first side of at least one of the plurality of pages; and binding the plurality of pages together, wherein said separation line has a first segment and a second segment, said first segment being a substantially straight line and extending from a first point on or at said first edge of said at least one of said plurality of pages to a second point spaced inwardly from said first edge, said second point being closer to said second edge than said first point, said second segment being substantially parallel with said first edge and extending from said second point to a third point on said page, said third point being closer to said second edge than said second point, and when said page is separated along said separation line, a page marker integral with said page is formed from said page.

* * * * *